US008777353B2

(12) United States Patent
Kuiper

(10) Patent No.: US 8,777,353 B2
(45) Date of Patent: Jul. 15, 2014

(54) METHOD OF CAMOUFLAGING ARTIFACTS IN HIGH COVERAGE AREAS IN IMAGES TO BE PRINTED

(71) Applicant: Oce Technologies B.V., Venlo (NL)

(72) Inventor: Paul Kuiper, Eindhoven (NL)

(73) Assignee: OCE-Technologies B.V., Venlo (NL)

( * ) Notice: Subject to any disclaimer, the term of this patent is extended or adjusted under 35 U.S.C. 154(b) by 31 days.

(21) Appl. No.: 13/770,434

(22) Filed: Feb. 19, 2013

(65) Prior Publication Data

US 2013/0182028 A1 Jul. 18, 2013

Related U.S. Application Data

(63) Continuation of application No. PCT/EP2011/064799, filed on Aug. 29, 2011.

(30) Foreign Application Priority Data

Sep. 14, 2010 (EP) ..... 10176529

(51) Int. Cl.

| | |
|---|---|
| ***B41J 29/38*** | (2006.01) |
| ***B41J 2/21*** | (2006.01) |
| ***B41J 2/07*** | (2006.01) |
| *B41J 2/205* | (2006.01) |

(52) U.S. Cl.

CPC . *B41J 2/07* (2013.01); *B41J 2/2139* (2013.01)
USPC ..... 347/12; 347/13; 347/14; 347/15

(58) Field of Classification Search

CPC .. B41J 2/0451; B41J 2/04541; B41J 2/04543; B41J 2/0458; B41J 2/07
USPC ..... 347/12–15
See application file for complete search history.

(56) References Cited

U.S. PATENT DOCUMENTS

| | | | | |
|---|---|---|---|---|
| 7,265,770 | B2 * | 9/2007 | Faken et al. | 347/171 |
| 7,316,464 | B2 * | 1/2008 | Shibata et al. | 347/14 |
| 7,639,402 | B2 * | 12/2009 | Vestjens et al. | 358/3.26 |
| 2007/0013729 | A1 | 1/2007 | Jung | |
| 2007/0153035 | A1 | 7/2007 | Jung et al. | |
| 2008/0174622 | A1 | 7/2008 | Carlson et al. | |
| 2009/0244579 | A1 | 10/2009 | Inoue | |

FOREIGN PATENT DOCUMENTS

| | | | |
|---|---|---|---|
| EP | 1 536 371 | A1 | 6/2005 |

* cited by examiner

*Primary Examiner* — Laura Martin
*Assistant Examiner* — Jeremy Bishop
(74) *Attorney, Agent, or Firm* — Birch, Stewart, Kolasch & Birch, LLP

(57) ABSTRACT

A method of printing an image on a receiving medium includes increasing the number of pixels in each row of a part of the image by x pixels, resulting in the part of the image including m by n+x pixels; assigning a printing element to each added pixel; identifying pixels to which a compensating printing element of the defective printing element is assigned; changing the value of at least one identified pixel into an integer value greater than zero; increasing the first printer resolution in the main-scanning direction to a second printer resolution by multiplying the first printer resolution in the main-scanning direction with a factor equal to (n+x)/n; and printing the part of the image according to the second printer resolution in the main-scanning direction and according to the values of the pixels of the part of the image.

14 Claims, 6 Drawing Sheets

METHOD OF CAMOUFLAGING ARTIFACTS IN HIGH COVERAGE AREAS IN IMAGES TO BE PRINTED

CROSS REFERENCE TO RELATED APPLICATIONS

This application is a Continuation of International Application No. PCT/EP2011/064799, filed on Aug. 29, 2011, and for which priority is claimed under 35 U.S.C. §120. PCT/EP2011/064799 claims priority under 35 U.S.C. §119 to Application No. 10176529.5, filed in Europe on Sep. 14, 2010. The entirety of each of the above-identified applications is expressly incorporated herein by reference.

BACKGROUND OF THE INVENTION

1. Field of the Invention

The present invention relates to a method of printing an image on a receiving medium by a printer comprising at least one print head with printing elements, each printing element associated with at least one compensating printing element, the image comprising a raster with rows of n pixels and columns of m pixels, each pixel having a value zero or an integer value greater than zero, the rows intended to be printed at a first printer resolution in the main scanning direction, the method comprising the step of assigning a printing element to each pixel of a part of the image, the part of the image comprising a plurality of rows of the image.

2. Background of the Invention

Printers, like inkjet printers and electrographic printers, are able to print an image on a receiving medium by means of the printing elements and comprise a processor unit for controlling print parameters with respect to printing the image and for performing calculations with respect to printing of the image.

In an inkjet printer with a print head, such print parameters may, for example, be a velocity of a carriage on which the print head is positioned, a jet frequency with which marking material drops are ejected from printing elements of the print head, a paper step in a sub-scanning direction, perpendicular to the main scanning direction, and a drop size of the marking material drops ejected from printing elements of the print head, if the printer has the capability of ejecting marking material drops of different drop sizes.

The processor unit performs calculations regarding the pixel information of the pixels of the image or a part of the image. The pixel may have a value zero indicating that the pixel is not intended to be printed, or an integer value greater than zero indicating that the pixel is intended to be printed.

The pixel having an integer value greater than zero may be printed by an ink drop with a drop size corresponding to the integer value. In the case of more drop sizes, more different values greater than zero may be used to indicate the drop size, for example, 1 (small drop size), 2 (middle drop size) and 3 (large drop size).

The processor unit also performs calculations regarding assignation of a printing element in the print head which is going to eject a marking material drop in order to print the pixel on the receiving medium. In the case of a printer using a plurality of process colors, a pixel has a value zero or an integer value greater than zero for each process color.

The processor unit determines a range of printer resolutions in a main scanning direction, while a predetermined printer resolution may be used in a sub-scanning direction. A printer resolution in one of the main- or sub-scanning directions is defined as a number of marking material drops to be ejected on the receiving material per length unit, for example 300 dpi (dots per inch). A printer resolution may also be expressed in a combination of the printer resolution of the main scanning direction and the printer resolution in the sub-scanning direction, for example 300 by 300 dpi or 300 by 2400 dpi. Such a printer resolution in either direction may be dependent on the printing parameters mentioned above. For example, if the velocity of the carriage is increasing, the printer resolution in the main-scanning direction becomes smaller. If the velocity of the carriage is decreasing, the printer resolution in the main-scanning direction becomes larger. If the jet frequency of the printing elements is increasing, the printer resolution in the main-scanning direction becomes larger. If the jet frequency of the printing elements is decreasing, the printer resolution in the main-scanning direction becomes smaller. Hereinafter we will presume that the marking material drop size is constant. However, the method may also be adapted to the use of marking material drops of different sizes.

The printing parameters may be tuned to obtain a printer resolution in the main-scanning direction out of the range of possible printer resolutions in the main-scanning direction. An engine of the printer may print the image on the receiving medium according to the values of the print parameters, resulting in a printed image with the desired printer resolution.

However, a problem may arise when a printing element becomes defective and does not eject a marking material drop any more. This may result in an artifact in the image, for example a white line in the image. Methods of camouflaging such artifacts, for example printing element failure correction methods, are known in the art. For example, neighboring printing elements may eject extra drops to compensate for the missing drops from the defective printing element. Printing element failure correction methods are applicable so that image information of a pixel that is assigned to a defective printing element is shifted to a nearby pixel position where it can be printed by a non-defective printing element.

In an ink jet printer, the print head of which comprises a plurality of nozzles as print elements, typically the nozzles are arranged in a line that extends in parallel with a direction (sub-scanning direction) in which a recording medium, e.g. paper, is transported through the printer, and the print head scans the paper in a direction (main scanning direction) perpendicular to the sub-scanning direction. In a single-pass mode, commonly a complete swath of the image is printed in a single pass of the print head, and then the paper is transported by the width of the swath so as to print the next swath or in general the single-pass mode is a mode wherein each position on the receiving medium to be covered by an ink drop according to the binary pixel information of the image is reachable only once by one nozzle. A pixel line in the binary pixel information may be printed by only one nozzle. In that case, when a nozzle of the print head is defective, e.g. has become clogged, the corresponding pixel line is missing in the printed image, so that image information is lost and the quality of the print is degraded.

A printer may also be operated in a multi-pass mode, in which only part of the image information of a swath is printed in a first pass and the missing pixels are filled-in during one or more subsequent passes of the print head. In the multi-pass mode, it is possible that a defective nozzle is backed-up by a non-defective nozzle, though mostly on the cost of productivity.

EP 1536371 discloses a method of the type indicated above, wherein, when a nozzle is defective, the print data are altered so as to bypass the faulty nozzle. This means that a pixel that would have, but cannot, be printed with the defective nozzle, is substituted by printing an extra pixel in one of the neighboring lines that are printed with non-defective nozzles, so that the average coverage of the image area is conserved and the defect resulting from the nozzle failure is camouflaged and becomes almost imperceptible. The method disclosed in EP 1536371 involves an algorithm that operates on a bitmap, which represents the print data, and shifts each pixel that cannot be printed to a neighboring pixel position.

However, such a camouflaging technique as described in EP 1536371 does not work sufficiently in the case of printing an image containing a high coverage area. In a high coverage area, all or nearly all pixel positions are intended to be printed with marking material from the printing elements of the print head. For example, in case of a solid part, the image coverage of that solid part is 100% and there are no pixel positions in neighboring lines which are available to cover up the image data for a pixel line to be printed by a defective printing element, because all of these pixel positions are already to be covered by marking material drops ejected from the other printing elements as being part of the high coverage area. Therefore, in a high coverage area, a small white line is visible in the printed image at the position of pixels of a defective printing element.

An example of such a situation is shown in FIGS. 3A-3C. A print head controller 24 or an image processor may address a nozzle to each pixel of a bitmap, for example a solid of 8 rows 31-38. Each row 31-38 of the solid is intended to be printed by a different nozzle out of the plurality of nozzles of the print head. When printing this solid of FIG. 3A on a receiving medium, ink drops 39 are ejected from the at least eight nozzles onto a part 300 of the receiving medium. The printed bitmap is shown in FIG. 3B. The ink drops 39 on the receiving medium are schematically represented by non-overlapping solid circles for convenience purposes. However, in practice, neighboring ink drops ejected on the receiving medium may partially overlap each other.

Upon detection of a defective nozzle, the rows which were to be printed by the defective nozzle are identified by the print head controller. For example, the third row 33 of the bitmap 25 was intended to be printed by the defective nozzle. However, the pixels of the third row 33 cannot be printed on the receiving medium, due to the defective nozzle. If the bitmap would be printed without any further image processing steps, the printed bitmap on the receiving medium would show up as shown in FIG. 3C. A white line 330 appears in the printed bitmap. Usually, a defective nozzle would be compensated by other nozzles. For example, the neighboring nozzles of the defective nozzle, which are addressed to the pixels of the second row 32 and the fourth row 34, could eject compensating ink drops to decrease the effect of the white line 330. The ink drops intended to be printed by the defective nozzle and by the compensating nozzles would cover a camouflaging area 340. Ink drops intended to be printed by the other nozzles would cover a two-part non-camouflaging area 350 outside the camouflaging area 340.

In order to eject extra compensating ink drops, the values of pixels in the second row 32 and/or pixels in the fourth row 34 should be turned from a value zero into an integer value greater than zero, in this case one. However, since there are no pixels 30 in the second row 32 and fourth row 34 which have a value zero, this is not possible. Moreover, since there are no pixels 30 in the solid at all which have a value zero, the defective nozzle cannot be compensated by means of extra ink drops by giving any other pixel 30 to be printed by other non-defective nozzles 31, 32, 34, 35, 36, 37, 38 a value of one. All the pixels 30 already have a value of one, so no extra ink drops can be generated by adapting any of the values of the pixels 30 of the bitmap 25.

In view of the above, especially when printing in a productive printing mode in which each pixel is only addressed once by a printing element, the defective printing element cannot be compensated by another printing element.

SUMMARY OF THE INVENTION

It is an object of the present invention to provide a method according to which image defects in a high coverage area to be caused by defective print elements are camouflaged.

According to the invention, this object is achieved by a method of the type indicated above, which method comprises upon detection of a defective printing element among the assigned printing elements the steps of: b) increasing the number of pixels in each row of said part of the image by x pixels, each pixel having a value zero, resulting in said part of the image comprising m by n+x pixels; c) assigning a printing element to each pixel added to said part of the image in step b); d) identifying pixels to which a compensating printing element of the defective printing element is assigned and which have a value zero; e) changing the value of at least one identified pixel into an integer value greater than zero; f) increasing the first printer resolution in the main-scanning direction to a second printer resolution in the main-scanning direction by multiplying the first printer resolution in the main-scanning direction with a factor equal to (n+x)/n; and g) printing said part of the image on the receiving medium according to the second printer resolution in the main-scanning direction and according to the values of the pixels of said part of the image.

The present invention is based on the concept that basically, adding of pixels results in extra positions on the receiving medium on which marking material drops may be ejected. These extra positions are used for ejecting additional marking material drops in case of a defective printing element. However, by adding pixels to the bitmap, the size of the bitmap becomes larger. The number of pixels to be added is dependent on the kind of marking material and the number of missing marking material drops due to the defective printing element. In order to obtain a printed image on the receiving medium, which is substantially equal in size to the printed image when no printing element is defective, the printer resolution is increased. The printer resolution may be increased by changing printing parameters such as the velocity in the main-scanning direction of a carriage upon which the print head is mounted or the jet frequency of marking material drops from the printing elements of the print head, or both parameters.

By applying these further steps before printing the image, there are now pixels with a value zero, even in high coverage areas, such as a solid area. These pixels with a value zero relate to positions on the receiving medium which are not to be covered by marking material. In the case that there is a defective printing element, these positions are available to eject extra marking material drops from non-defective printing elements in order to camouflage the positions which should have been covered with marking material drops which should have been ejected from the defective printing element. The step of adding extra pixels among the original pixels of the image may be carried out in such a way that for each pixel which would have been printed by the defective printing element on a certain position on the receiving medium, a compensating printing element other than the defective printing element ejects a marking material drop in the neighborhood of that certain position.

The image usually comprises pixel positions in pixel columns and pixel rows. An image resolution is defined with a set of two positive integer numbers, where the first number is the number of pixel rows (height in sub-scanning direction) per a length unit and the second number is the number of pixel columns (width in main scanning direction) per the same length unit, for example as 300 dpi by 2400 dpi.

Upon detection of a defective nozzle, a plurality of pixels in the image are added, which are initially left blank. These added pixels are used in the case that a printing element is defective. Especially in high coverage areas of the image, these pixels are always available for ejection of marking material from a compensating printing element of the defective printing element in order to palliate the artifacts due to the defective printing element.

In order to obtain the same dimensions of the printed image on the receiving medium, before and after the addition of extra pixels to the image, the printer resolution has to be increased. By doing so, the print quality loss of, for example, an optical density, due to the addition of extra pixels is minimized or even fully compensated.

An increase of the printer resolution may be realized by an increase of the velocity of the print head in the main-scanning direction or an increase of the jet frequency of marking material from the printing element of the print head.

According to the present invention, the print resolution of the image in the main-scanning direction is increased with a factor being equal to a quotient of the original number of pixels in a row of the image in the main-scanning direction plus the number of added pixels in the main-scanning direction and the original number of pixels in a row of the image in the main-scanning direction. It is advantageous to use such a factor since the loss of image quality due to the reduction of the optical density of the image is fully compensated by the increase of the printer resolution. For example, when in the original image a full coverage area like a solid is desired and addition of the extra pixels results in a coverage of 90%, the increase of the printer resolution may be approximately 11% (1/0.9).

By changing values of pixels to be printed by compensating printing elements into an integer value greater than zero, extra marking material is ejected in the neighborhood of the missing drops due to the defective printing elements. The space originally left open due to the missing drops is coalesced by the extra marking material. A marking material to be applied may be hot melt ink, phase change ink, UV-curable ink, aqueous ink, solvent ink or toner. In principal, every marking material may be used that has such a coalescing effect for an area to be camouflaged that, after ejecting the extra drops, an uncovered area remains having a maximum width in a range of 10-15 micrometer. The coalescing effect may be influenced by the printer resolution in the sub-scanning direction as well as the printer resolution in the main-scanning direction.

According to an embodiment of the present invention, the number of x pixels to be added is determined by selecting the factor (n+x)/n from the interval [100/95, 3/2]. Experiments have revealed that a factor selected from this interval results in a desired camouflaging of the defective printing element in a high coverage area in the printed image.

According to an embodiment of the present invention, the method is carried out by a printer having a print head, which prints the image in a number of swathes and a part of the image is printed in exactly one swath. This is advantageous since the defective printing elements are determined per swath. A defective printing element in a first swath may not be defective any longer in a second swath, after recovery operations have been carried out between the first swath and the second swath. This improves the overall productivity of the printer.

According to an embodiment of the present invention, the method comprises a step of determining a first percentage such that upon the detection of the defective printing element, the steps b)-g) are only carried out if the number of pixels of the part of the image having an integer value greater than zero is more than the first determined percentage of the total number of the pixels of the part of the image, and otherwise a step of printing the part of the image at the first printer resolution is carried out.

This is advantageous, since the method does not have to be carried out in a low coverage area, since in such a low coverage area the number of pixels having a value zero and addressed by compensating nozzles of a defective printing element is large enough to cover up artifacts due to the defective printing element.

According to a further embodiment, the first percentage is determined from a range from 66% to 90%. Experiments have revealed good improvement of print quality in case of a defective printing element by determining the first percentage from this range.

According to an embodiment of the present invention, the method comprises a step of determining a second percentage such that upon detection of the defective printing element, the steps b)-g) are only carried out if the number of pixels of the part of the image which are intended to be printed by the defective printing element and are not to be compensated by a compensating printing element of the defective printing element is more than the second determined percentage of the number of pixels of the part of the image which are intended to be printed by the defective printing element, and otherwise a step of printing the part of the image at the first printer resolution is carried out.

The second percentage is preferably determined from a range of [1%, 5%]. Before applying the method it may be checked how many pixels intended to be printed by the defective printing element cannot be compensated for. If this number is more than the second determined percentage, the steps b)-g) are applied. This will lead to a higher productivity.

According to an embodiment of the present invention, the method step of increasing the number of pixels is according to an even distribution. By an even distribution of the added pixels, there will always be an added pixel in the neighborhood of each pixel of the image. If such a pixel of the image cannot be printed, it may be compensated for by the added pixel in the neighborhood of the pixel. Such an even distribution of the added pixels may be achieved by randomly adding the pixels in the image. A random number generator as part of the processor unit of the printer may be used to determine a place in the image at which an extra pixel is added.

According to an embodiment of the present invention, the method step of increasing the number of pixels is according to a modulo distribution of a predetermined number of pixels to be printed in the main-scanning direction. This is advantageous since is makes the addition of the extra pixels easily computable by an image processor unit of the printer. It also results in an even distribution of the extra pixels among the pixels of the original image.

According to an embodiment of the present invention, the method step of increasing the number of pixels is achieved via a halftoning step in case of a grey-scale image. In a first step, the grey-scale image is scaled up to add extra pixels, which values are determined by interpolation of the values of the pixels of the original image. In a second step, a coverage percentage is set which is lower than 100%. In a third step, the value of every pixel is scaled downward according to the set coverage percentage, for example linearly. After downscaling the values, a (multi-level) halftoning step may be applied on the pixels. The halftoning step creates pixels with a value of zero. These pixels can be used for compensation according to the present invention.

According to an embodiment of the present invention, the method step of increasing the number of pixels is achieved by dividing each pixel into a plurality of sub-pixels. Sub-pixel filling divides each pixel into a plurality of pixels, each of which may be filled with bitmap information according to the bitmap. For example, a 300×300 dpi bitmap may be transformed into a 300×2400 dpi bitmap. Each original pixel is divided into 8 sub-pixels. In the case of a binary bitmap, each of the 8 sub-pixels gets the same value as the value of the original pixel. However, to obtain extra sub-pixels with a value of zero, a smaller number than eight sub-pixels may obtain the value of the original pixel. For example, if the original pixel has a value of one and the pixel is divided into 8 sub-pixels, from these 8 sub-pixels, 7 sub-pixels may obtain a value of one, while one of the eight sub-pixels may obtain a value of zero. This one sub-pixel having a value of zero may be used for compensating purposes according to the present invention in a bitmap comprising high coverage areas. This step of sub-pixeling is also an advantageous step, since an image processor unit of the printer may easily compute the dividing of each pixel of the original bitmap into a plurality of sub-pixels. It also prevents print artifacts due to interpolation of values of neighboring pixels in the bitmap. In case of a grey-scale bitmap, each pixel may be multi-level halftoned to have a level. The number of sub-pixels getting a value of one corresponds to the level of the halftoned pixel. In case of an inkjet printer printing in swathes, the number of sub-pixels may be one or two more in swathes in which compensation is necessary than in swathes in which no compensation is needed.

According to an embodiment of the present invention, the printer resolution in the main scanning direction is a multiple of the printer resolution in the sub-scanning direction. This is advantageous because the number of the plurality of sub-pixels per original pixel may be easily selected. The number of sub-pixels is, for example, selected as a quotient of the printer resolution in the main-scanning direction and the printer resolution in the sub-scanning direction.

The present invention also discloses a printer comprising a processor unit and a print engine, wherein the processor unit is configured to carry out the steps a)-f) of the method according to any of the preceding embodiments of the method according to the present invention and the print engine is configured to carry out the step g) of the method according to any of the preceding embodiments of the method according to the present invention.

According to an embodiment of the printer, the printer comprises an image processor unit adapted to carry out the steps a)-f) of the method according to any of the preceding embodiments.

The present invention also discloses a computer program embodied on a non-transitory computer readable medium and comprising computer program code to enable a printer according to any of the printer embodiments described hereinabove in order to execute the method of any of the preceding embodiments according to the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMEMTS

The embodiments will now be explained considering an ink jet printer as a printer comprising a print head with nozzles as printing elements. However, it should be understood that the present invention can be applied to other printers as well. In particular, any other printer using any of the suitable marking materials mentioned hereinabove may use the methods according to the embodiments of the present invention.

Figure 1:
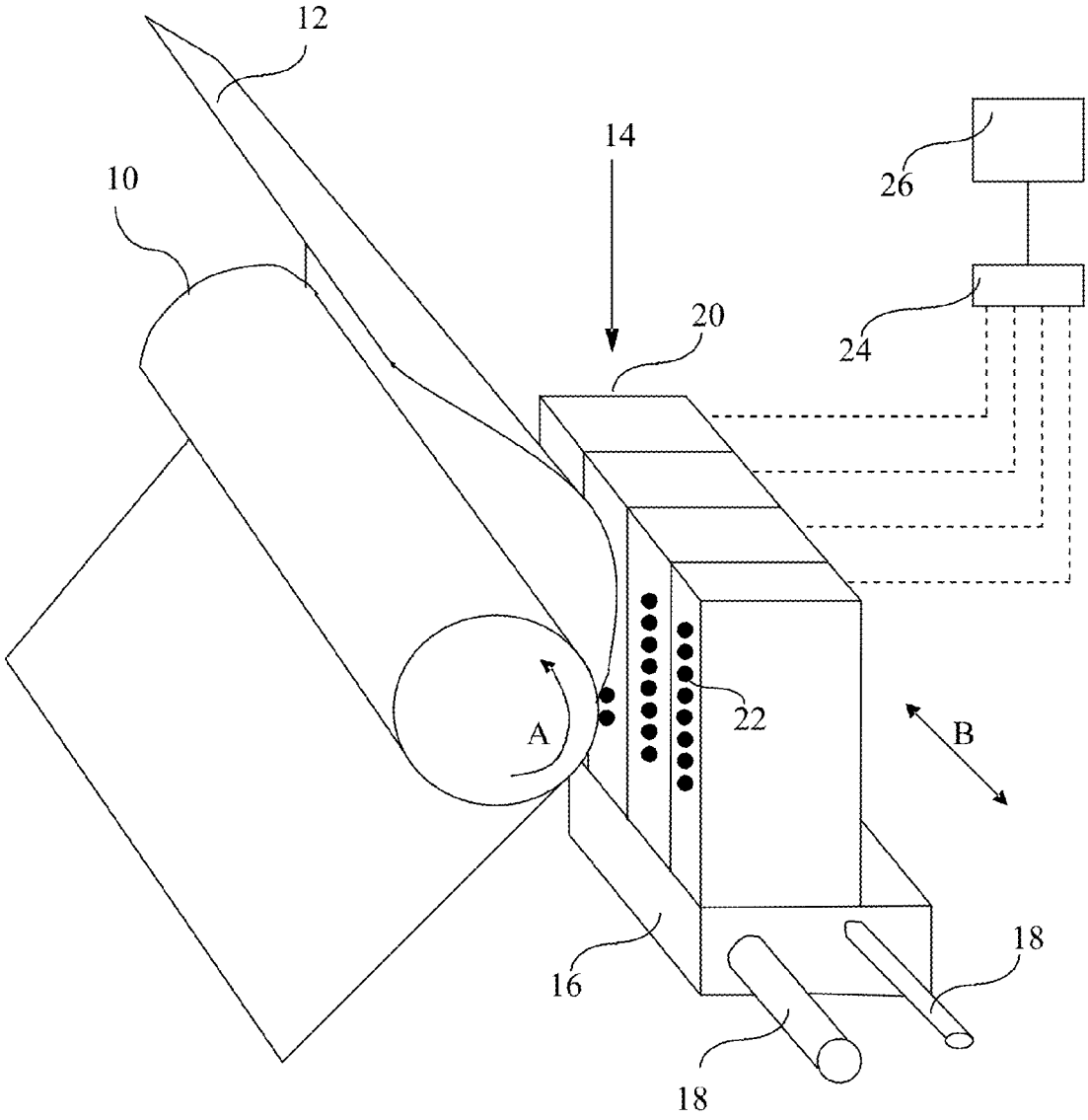
FIG. 1 is a schematic view of an ink jet printer to which the present invention is applicable.

As is shown in FIG. 1, an ink jet printer comprises a platen 10 which serves for transporting a recording paper 12 in a sub-scanning direction (arrow A) past a print head unit 14. The print head unit 14 is mounted on a carriage 16 that is guided on guide rails 18 and is movable back and forth in a main scanning direction (arrow B) relative to the recording paper 12. In the example shown, the print head unit 14 comprises four print heads 20, one for each of the basic colors cyan, magenta, yellow and black. Each print head has a linear array of nozzles 22 extending in the sub-scanning direction. The nozzles 22 of the print heads 20 can be energized individually to eject ink droplets onto the recording paper 12, thereby to print a pixel on the paper. When the carriage 16 is moved in the direction B across the width of the paper 12, a swath of an image can be printed. The number of pixel lines of the swath corresponds to the number of nozzles 22 of each print head. When the carriage 16 has completed one pass, the paper 12 is advanced by the width of the swath, so that the next swath can be printed.

The print heads 20 are controlled by a print head controller 24, which receives print data in the form of a multi-level pixel matrix from an image processor 26 that is capable of high speed image processing. The image processor 26 may be incorporated in the printer or in a remote device, e. g. a print driver in a host computer. The print head controller 24 and the image processor 26 process the print data in a manner that will be described in detail hereinafter. The discussion will be focused on printing in black color, but is equivalently valid for printing in the other colors.

Figure 2:
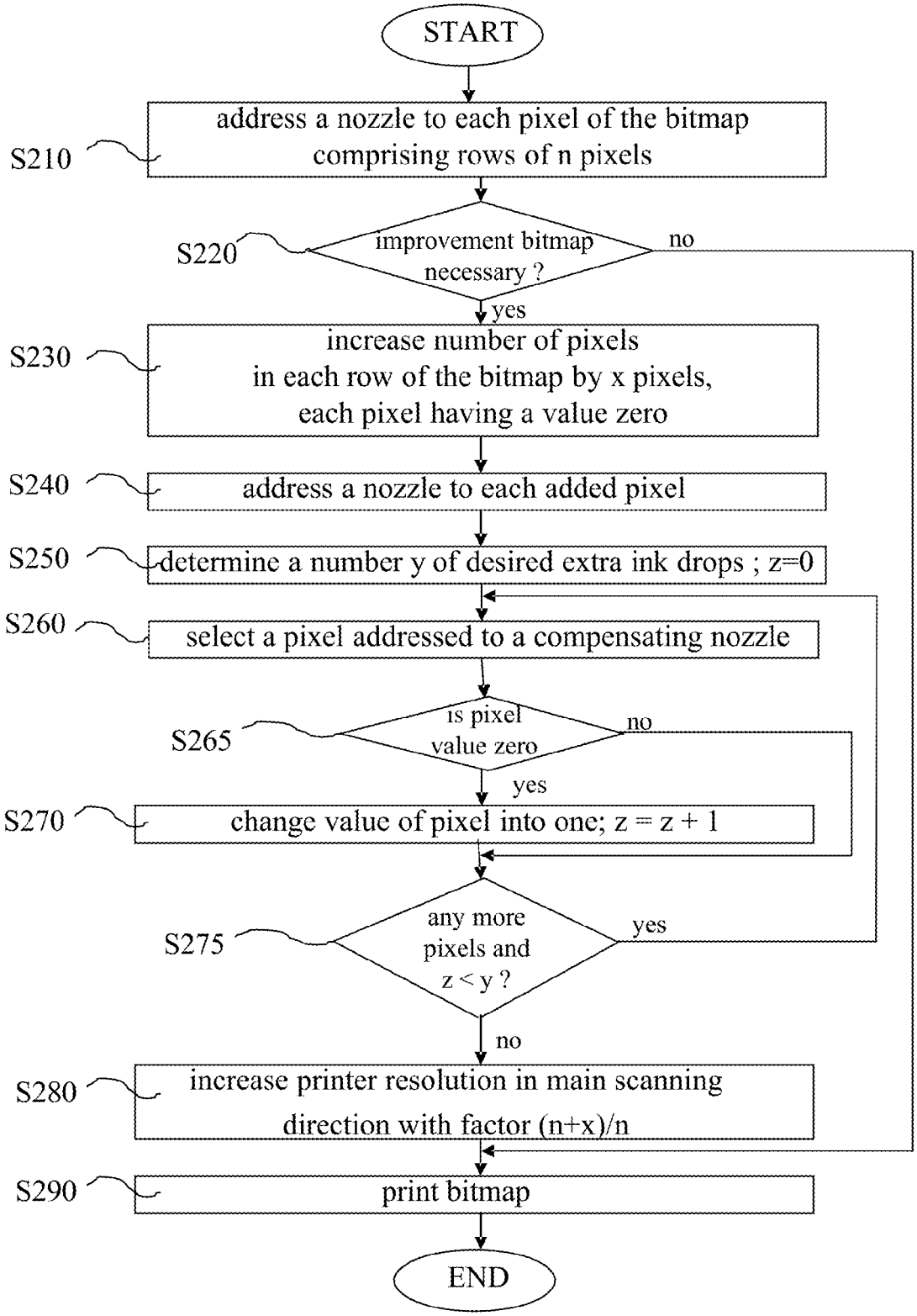
FIG. 2 is a flow diagram of the method according to the present invention.

FIG. 2 is a flow diagram of an embodiment of the method according to the present invention. Steps S210-S290 of the method are explained hereinafter.

Figure 3A:
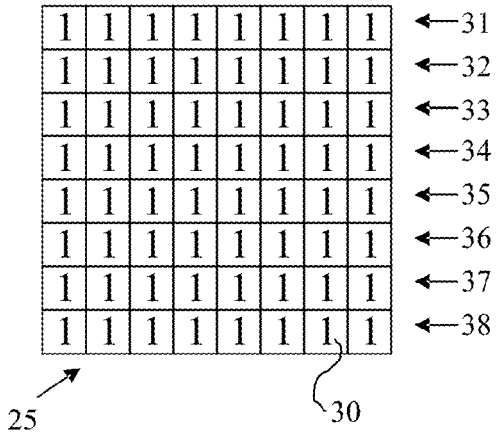
FIG. 3A is a schematic representation of a bitmap of an image to be printed.
Figure 3B:
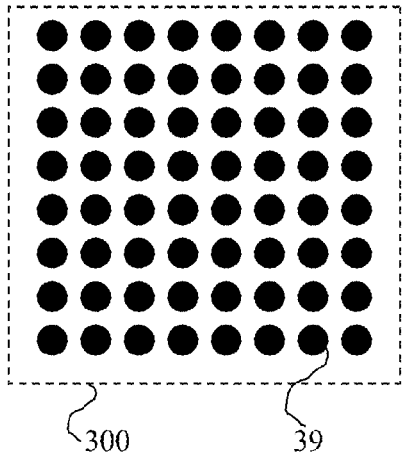
FIG. 3B is a schematic representation of the bitmap shown in FIG. 3A printed on a receiving medium with ink drops.

Typically, an image of pixels is to be printed, for example a bitmap of 300 by 300 dpi, which bitmap contains high coverage parts. For convenience reasons, the method according to the present invention is explained with, as a starting point, a high coverage image 25, being a solid of 8 by 8 pixels shown in FIG. 3A. However, the method may be applied on any bitmap which may be printed by the printer in FIG. 1 and contains high coverage parts. The method according to the present invention provides excellent results, if the number of pixels of the part of the image having a value of one is more than a determined percentage of the total number of the pixels of the part of the image, where the percentage is determined in a range of [66%, 90%]. In the solid of FIG. 3A, the number of pixels having a value of one is 100%.

The image 25 may be created in or supplied to the image processor 26 of the printer in FIG. 1. Each pixel 30 of the image 25 is intended to be printed, and therefore has a value of one. This solid may be printed by a printer having a print head as shown in FIG. 1.

The image may be intended to be printed with a printer resolution of 300 dpi in the main-scanning direction as well as in the sub-scanning direction.

In a first step S210, the print head controller 24 or the image processor 26 assigns a nozzle to each pixel of the image 25. For example, each row 31-38 of the solid may be intended to be printed by a different nozzle out of the nozzles 22 as shown in FIG. 1.

In a first decision step S220, it is checked if an improvement of the bitmap is necessary before printing the bitmap. A first check is the presence of a defective nozzle. Optionally, a second check may be if the defective nozzle is printing a high coverage area, such as the solid 25 with 100% coverage. Optionally, a third check may be if the number of pixels of the image 25, which are intended to be printed by a defective printing element, and are not to be compensated by a compensating printing element of the defective printing element, is higher than a determined percentage of the number of pixels of the image 25, which are intended to be printed by the defective printing element. The determined percentage may be selected from a range of [1%, 5%]. The number of eight pixels of the image 25, which are intended to be printed by the defective printing element cannot be compensated for by a compensating printing element of the defective printing element. Thus, the percentage of 100% of the number of pixels of the image 25, which are intended to be printed by the defective printing element, is much higher than 5%.

If the check in the first decision step S220 is negative, no improvement of the bitmap is necessary and a step S290 of printing the original solid without any improvements may be executed by the original intended printer resolution of 300 dpi by 300 dpi.

Figure 3C:
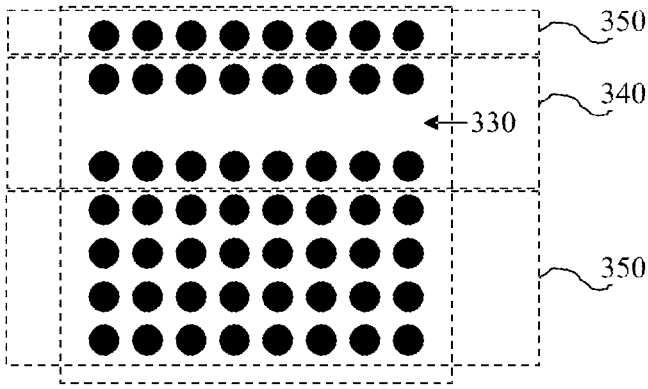
Fig. 3C (Prior Art)
FIG. 3C is a schematic representation of the bitmap shown in FIG. 3B printed on a receiving medium.

If the check in the first decision step S220 is positive, the method proceeds with the next step S230. For example, the third row 33 of the image 25 was intended to be printed by the defective nozzle. The pixels of the third row 33 cannot be printed on the receiving medium. If the bitmap would be printed without any further image processing steps, the printed bitmap on the receiving medium would show up as shown in FIG. 3C.

Figure 4A:
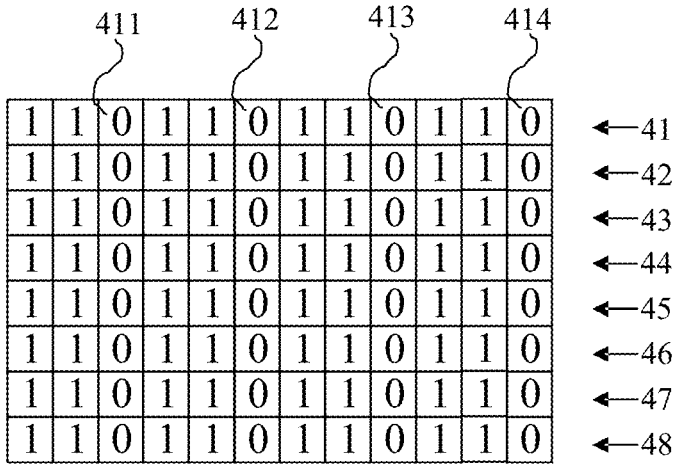
FIG. 4A is a schematic representation of the bitmap shown in FIG. 3A with added pixels.

In a next step S230 according to the method of the present invention, pixels are added to the solid of 8 by 8 pixels. For example, in each row of the 8 by 8 pixels, four extra pixels are added having a value zero. There are several manners to add these extra pixels. One possible addition is an addition according to a modulo distribution as shown in FIG. 4A. A first pixel 411, a second pixel 412, a third pixel 413 and a fourth pixel 414 are added in the first row 41 of the bitmap. In every row 41-48 four pixels having a value zero are added. Since we have added four pixels for each row, the total number of added pixels is 32. In FIG. 4A, the added pixels form four columns of the bitmap. However, pixels in each row may be added in such a way that added pixels in neighboring rows are not in the same column. Pixels may even be added randomly as long as the number of added pixels per row is the same. The bitmap now comprises a raster of 8 rows and 12 columns. The quotient of the number of twelve pixels in a row of the image 25 modified in this step S230, and the number of eight pixels in a row of the original image 25 is equal to 3/2. Experience has shown good results for adding pixels wherein such a quotient is in a range of [100/95, 3/2].

In a next step S240, a nozzle is assigned to each pixel added to the bitmap in the previous step. In an embodiment, the nozzle which is addressed to the added pixel in a row is the nozzle addressed to the original pixels of the same row. For example, a nozzle addressed to the first pixel 411, the second pixel 412, the third pixel 413 and the fourth pixel 414 is the same nozzle, which is intended to print the remaining pixels in the first row 41 of the bitmap.

In a next step S250, a number y of extra desired ink drops are determined. These extra ink drops are intended to compensate for the missing ink drops from the defective nozzle. This number of extra ink drops may be at most equal to the number of missing ink drops. The number may be less in order to achieve the goal of camouflaging the white line S330 in FIG. 3C, as is also clear when taking the range [100/95, 3/2] revealed by experiments and mentioned earlier into account.

In a next step S260, a pixel is identified to which a compensating nozzle of the defective nozzle is assigned. In an embodiment, the nozzles which are intended to print the neighboring rows 42, 44 of the third row 43, which pixels would have been printed by the defective nozzle, may be identified as nozzles which are capable of compensating the defective nozzle.

In a first decision step S265, it is checked if the pixel has a value zero. If not, a next step S270 is skipped. If so, the method proceeds with the next step S270. It is noted that there is at least one added pixel in each row of the bitmap having a value zero. Therefore it is always possible to find a pixel having a value zero and to which a compensating nozzle is assigned. Pixels in these neighboring rows 42, 44 having a value zero are the four added pixels in each neighboring row 42, 44. Pixels are searched in the neighboring columns of the defective nozzle, e.g. four pixels in the neighboring rows to the left of the defective nozzle and to the right of the defective nozzle.

In the next step S270, the value zero of the pixel is changed into a value of one.

In a second decision step S275, it is checked if the number of changed values is less than the number of desired extra ink drops and if there are any pixels left to be selected. If not, no other pixels are to be investigated and the method proceeds with a next step S280. If so, the method returns to the step S260 of identifying a next pixel to which a compensating nozzle of the defective nozzle is assigned.

Figure 4B:
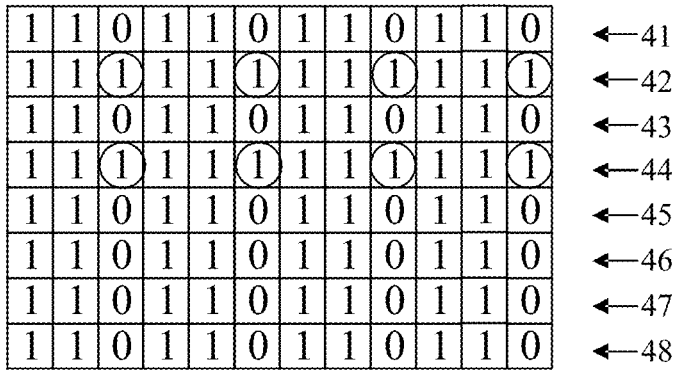
FIG. 4B is a schematic representation of the bitmap shown in FIG. 4A with changed pixel values.

In order to obtain a sufficient compensation for the defective nozzle, the values of all identified pixels may be changed into a value of one. In FIG. 4B, the values of eight pixels are changed from zero to one, which pixels are encircled in the bitmap shown in FIG. 4B.

Figure 4C:
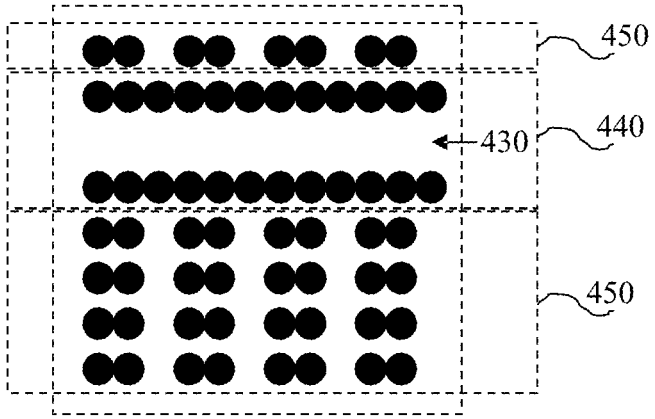
FIG. 4C is a schematic representation of the bitmap shown in FIG. 4B printed on a receiving medium.

In the next step S280, the value of the selected printer resolution in the main scanning direction is going to be changed, according to the number of added pixels, by means of a multiplication factor equal to (8+4)/8. The factor becomes (8+4)/8 equaling 1.5. So the printer resolution in the main scanning direction will become (300×1.5) dpi, which equals 450 dpi. Since a number of pixels is added in each row of the bitmap, the method is also applicable in the case of more than one defective nozzle, provided that each of the defective nozzles has at least one non-defective compensating nozzle. The number of added pixels per row may be determined by the maximum of the missing ink drops of a row intended to be printed by a defective nozzle. By varying the number of extra pixels, which value is going to be changed from zero into one, the number y of desired extra ink drops may vary per row of a defective nozzle In a final step S290, the bitmap according to FIG. 4B is printed on the receiving medium according to the increased printer resolution of 450 dpi in the main scanning direction and according to the values of the pixels in the bitmap shown in FIG. 4B. The printed bitmap is shown in FIG. 4C. By applying the increased printer resolution of 450 dpi in the main scanning direction, the size of the printed bitmap after addition of the extra pixels remains the same as a size of a bitmap when printed with the old printer resolution of 300 dpi in the main scanning direction which was initially selected and without addition of the extra pixels.

Since at least one additional pixel has obtained a value of one, the missing ink drops from the defective nozzle are compensated for to a certain extent. The more additional pixels have obtained a value of one, the more compensating ink drops are ejected in the same area of the receiving medium where the bitmap is printed upon.

Since all pixels are printed closer to each other in the main scanning direction due to the increased printer resolution in the main scanning direction, the white line 430 which was significant present as shown in FIG. 3C, if the original bitmap 25 would be printed without compensation steps described here-above, will now be almost coalesced by the greater number of ink drops ejected by the neighboring nozzles of the defective nozzle.

The number of ink drops in a non-camouflaging two-part area 450 remains the same compared with the non-camouflaging two-part area 350 in FIG. 3C, namely 5 times 8 ink drops. The number of 24 ink drops in a camouflaging area 440 also remains the same compared with the number of 24 ink drops intended to be ejected in the camouflaging area, if no defective nozzle was present in the print head. This means that the number of ink drops of the printed bitmap with the defective nozzle is equal to the number of ink drops of the printed bitmap in case of no defective nozzle. In other words, the coverage of the printed bitmap, defined as the number of ink drops per area unit, is equal to the coverage of the printed bitmap in case of no defective nozzle.

Theoretically, in order to fully compensate for the missing printed pixels in the row of the defective nozzle in a single pass mode, the amount of added pixels to be printed by compensating nozzles should be the same as the number of pixels not printed because of the defective nozzle. For example, in each row of a compensating nozzle, the number of added pixels which value is going to be changed into a value of one should be the same as the original number of pixels in a row of the bitmap divided by the number of compensating nozzles.

In order to fully compensate a defective nozzle in an interleave mode, in which, for example, odd pixels in a row are printed by a different nozzle than the even pixels in the row, the number of added pixels intended to be printed may be half of the number of pixels in a row. Dividing the number of added pixels intended to be printed, by the number of rows printed by compensating nozzles, the number of added pixels per row is obtained. For example, in the case of two neighboring compensating nozzles of a defective nozzle, the number of added pixels per row is a quarter of the original number of pixels of a row in the bitmap.

Generally, in an n-multi-interleave mode in which each row to be intended to be printed by a defective nozzle which may be compensated by two other nozzles, the number of added pixels may per row be a 1/(2n) part of the original number of pixels in a row.

In practice, however, the number of added pixels may be significantly less than the amounts mentioned hereinabove because of the process of coalescing of the row to be intended to be printed by the defective nozzle by the increased number of ink drops ejected by the neighboring nozzles in the neighboring rows. Research has revealed that for an inkjet printer with hot melt ink, the amount of added pixels selected from a range between ⅙ and ⅓ of the original amount of pixels in a row of the bitmap give excellent results in order to camouflage the defective nozzle in a single pass mode. In a double pass mode the range for good camouflaging results is between 1/12 and ⅙.

Figure 5A:
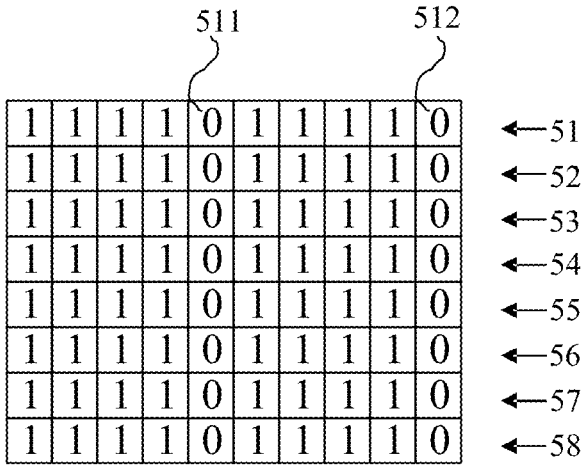
FIG. 5A is a schematic representation of the bitmap shown in FIG. 3A with added pixels.
Figure 5B:
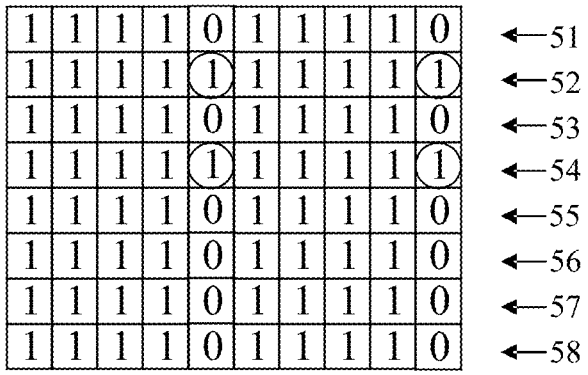
FIG. 5B is a schematic representation of the bitmap shown in FIG. 5A with changed pixel values.
Figure 5C:
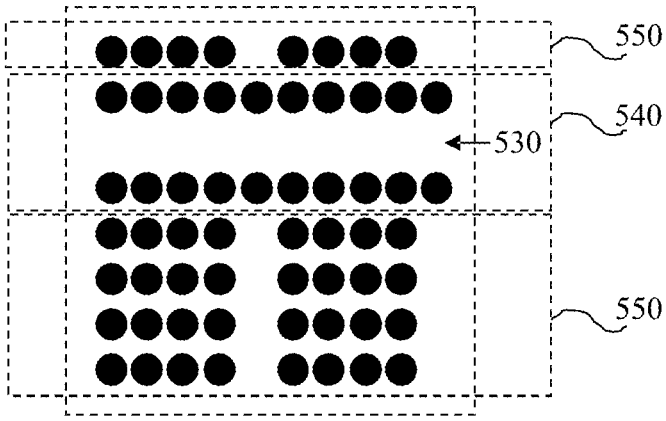
FIG. 5C is a schematic representation of the bitmap shown in FIG. 5B printed on a receiving medium.

FIGS. 5A-5C show an embodiment of the method in which the pixels are added modulo a divisor of the number of pixels in an original row of the bitmap. In each row, an extra pixel is modulo 4 pixels in the row. For example, in the first row 51 a first pixel 511 is added after four pixels in the original row from the left and a second pixel 512 is added after eight pixels in the original row from the left. In this way, the compensating possibilities executable for each row are the same. In FIG. 5B, the values of four added pixels in the rows neighboring the defective row are turned into a value of one, indicated by encirclements in the bitmap shown in FIG. 5B. The printed bitmap is shown in FIG. 5C. A camouflaging area 540 comprises a white line 530, which will be coalesced by the extra ink drops in the camouflaging area 540 ejected by the compensating nozzles. The number of ink drops in a non-camouflaging two-part area 550 remains the same as in the non-camouflaging two-part area 350 in FIG. 3C. It is noted that the number of extra ink drops ejected by the compensating nozzles is four, while the number of missing ink drops due to the defective nozzle is eight. Despite the fact that the number of extra ink drops are only half the number of missing ink drops, the camouflaging effect of the method applies because of the coalescing of the white line 530 by the extra ink drops neighboring the white line 530.

For each row, the extra pixels may be added at different places in the row. Since the pixels are added modulo a divisor of the number of pixels in the original row of the bitmap, the amount of added pixels per row will always be the same when selecting a first addition of an extra pixel at a different column in the original bitmap in different rows. By doing so, a smooth compensating is achieved, especially when several swathes of the print head are necessary to print the bitmap. This will usually be the case since bitmaps may be intended to be printed up to a format of size A0.

In another embodiment of the method according to the present invention, the addition of the extra pixels is executed by adding to each pixel a plurality of pixels. From another point of view this may be explained as each pixel being divided into a plurality of sub-pixels. From this plurality of sub-pixels, a relatively large part may get the same value as the original pixels, while a relatively small part may get a value zero. For example, the plurality of sub-pixels may be 10 sub-pixels for each original pixel of the bitmap, from which plurality the relatively small part may be for example 1 or 2 sub-pixels. The sub-pixels in the relatively small part have the value zero and may be used for compensating purposes as described above.

Figure 6:
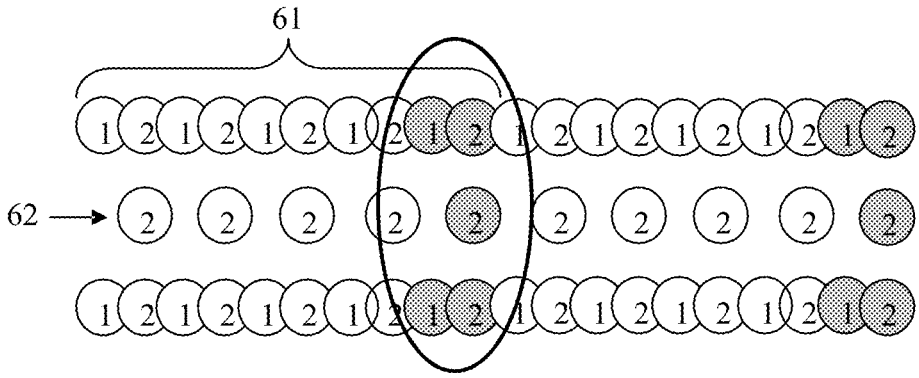
FIG. 6 is an example of applying sub-pixel filling to the pixels of a bitmap.

An embodiment of using sub-pixels according to the present invention is elucidated in FIG. 6. The printer comprises two print heads, each having a column of nozzles in the sub-scanning direction. This elucidation may also be applied to a printer comprising one print head with at least two columns of nozzles in the sub-scanning direction. At a printer resolution of 300 by 300 dpi each pixel 61 is intended to be printed in a single pass mode by ejecting 8 ink drops indicated by circles in FIG. 6. To camouflage a defective nozzle, extra ink drops must be available. The availability of the extra ink drops is achieved by decreasing the velocity of a carriage on which the two print heads are mounted. The printer resolution is increased by dividing each pixel into 10 sub-pixels. Under normal conditions only 8 of these 10 sub-pixels are used, indicated by the light circles in FIG. 6. At the moment that a nozzle becomes defective, the two additional sub-pixels, indicated by the darker circles in FIG. 6, per original pixel may be used to compensate for the ink shortage due to the defective nozzle. This is particularly useful in the case of printing solids. Each row of the bitmap may be printed by means of two nozzles, one nozzle of each print head. For example, odd pixels in each row will be printed by the first print head, while even pixels in each row will be printed by the second print head. This is indicated in FIG. 6 by the number 1 in the ink drop in case the ink drop is ejected by a nozzle of the first print head and by the number 2 in the ink drop in case the ink drop is ejected by a nozzle of the second print head. In the second row 62 of ink drops in FIG. 6 it is clear that a nozzle from the first print head is failing. The result is that at most 50% of the pixels of the row would not be printed. This would lead to a lighter line in the printed bitmap. The two extra sub-pixels per original pixel furnish the possibility to completely compensate the missing pixels to be printed by the defective nozzle. Each pixel 61 has ten sub-pixels of which two sub-pixels (darker colored) are reserved for compensating. In case of one defective nozzle, five additional ink drops, encircled with an oval in FIG. 6, are available to compensate four missing ink drops of the pixel 61 due to the defective nozzle.

Analogously, each original pixel of the bitmap may be divided into nine sub-pixels of which one sub-pixel is reserved for nozzle failure compensation.

Values of reserved pixels which are going to be used when compensating a defective nozzle are set to one.

The printer resolution of the printer is increased in the main scanning direction by means of a multiplication factor, which depends on the number of added pixels.

In the embodiment elucidated by FIG. 6, the printer prints eight ink drops per pixel. If the original bitmap was intended to be printed at a printer resolution of 300 dpi by 300 dpi, the resulting printer resolution is 300 by 2400 dpi. By dividing each pixel of the original pixel into ten sub-pixels instead of eight sub-pixels, the printer resolution becomes 300 by 2400 *(10/8)dpi=300 by 3000 dpi. The bitmap is printed on the receiving medium according to the increased printer resolution of 3000 dpi in the main scanning direction and according to the values of the sub-pixels of the bitmap, including the changed values of the extra sub-pixels. In this way, the defective nozzle is fully compensated for.

High coverage areas, even solids, are 100% compensated for. Since the printer is printing in a single pass mode, the increase of the printer resolution in the main scanning direction will lead to a productivity loss of approximately 20%. However, the productivity loss of 20% is much better than a productivity loss of 50% when the printer needs to print in a two pass-mode in which compensation is done by compensating nozzles in the second pass.

Moreover, for a printer which can only operate in a single pass mode, compensation in a second pass is impossible, since there is no second pass and the method according to the invention is pre-eminently applicable.

In another embodiment, each original pixel of the bitmap, to be printed on the receiving medium by eight ink drops, is divided into nine-sub-pixels of which one sub-pixel is reserved for nozzle failure compensation according to the previous embodiment. The printer resolution in the main scanning direction will become 2400* (9/8)=2700 dpi.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of printing an image on a receiving medium by a printer comprising at least one print head with printing elements, each printing element associated with at least one compensating printing element, said image comprising a raster with rows of n pixels and columns of m pixels, each pixel having a value zero or an integer value greater than zero, said rows intended to be printed at a first printer resolution in the main scanning direction, said method comprising the steps of:

a) assigning a printing element to each pixel of a part of the image, said part of the image including a plurality of rows of the image, and upon detection of a defective printing element among the assigned printing elements:

b) increasing the number of pixels in each row of said part of the image by x pixels, each pixel having a value zero, resulting in said part of the image comprising m by n+x pixels;

c) assigning a printing element to each pixel added to said part of the image in step b);

d) identifying pixels to which a compensating printing element of the defective printing element is assigned and which have a value zero;

e) changing the value of at least one identified pixel into an integer value greater than zero;

f) increasing the first printer resolution in the main-scanning direction to a second printer resolution in the main-scanning direction by multiplying the first printer resolution in the main-scanning direction with a factor equal to (n+x)/n; and g) printing said part of the image on the receiving medium according to the second printer resolution in the main-scanning direction and according to the values of the pixels of said part of the image.

2. The method according to claim 1, further comprising the step of determining the number of x pixels to be added by selecting the factor (n+x)/n from the interval [100/95, 3/2].

3. The method according to claim 1, wherein the method is carried out by a printer having a print head, which prints the image in a number of swathes, and a part of the image is printed in exactly one swath.

4. The method according to any of the preceding claim 1, said method comprising the step of determining a first percentage such that upon the detection of the defective printing element, the steps b)-g) are only carried out if the number of pixels of said part of the image having an integer value greater than zero is more than the first determined percentage of the total number of the pixels of said part of the image, and otherwise a step of printing the part of the image at the first printer resolution is carried out.

5. The method according to claim 4, further comprising the step of determining the first percentage from a range of [66%, 90%].

6. The method according to claim 1, further comprising the step of determining a second percentage such that upon detection of the defective printing element the steps b)-g) are only carried out in the case that the number of pixels of said part of the image which are intended to be printed by the defective printing element and are not to be compensated by a compensating printing element of the defective printing element is more than the second determined percentage of the number of pixels of said part of the image which are intended to be printed by the defective printing element, and otherwise a step of printing the part of the image at the first printer resolution is carried out.

7. The method according to claim 6, further comprising the step of determining the second percentage from a range of [1%, 5%].

8. The method according to claim 1, wherein said step of increasing of the number of pixels is according to an even distribution.

9. The method according to claim 8, wherein said step of increasing the number of pixels is according to a modulo distribution.

10. The method according to claim 8, wherein said step of increasing the number of pixels is according to a random distribution.

11. The method according to claim 1, wherein said step of increasing the number of pixels is achieved by dividing each pixel into a plurality of sub-pixels.

12. A printer comprising a processor unit and a print engine, wherein the processor unit is configured to carry out the steps a)-f), and the print engine is configured to carry out the step g) of the method according to claim 1.

13. The printer according to claim 12, wherein the processor unit comprises an image processor adapted to carry out the steps of a) assigning a printing element to each pixel of a part of the image, said part of the image including a plurality of rows of the image, and upon detection of a defective printing element among the assigned printing elements:

b) increasing the number of pixels in each row of said part of the image by x pixels, each pixel having a value zero, resulting in said part of the image comprising m by n+x pixels;

c) assigning a printing element to each pixel added to said part of the image in step b);

d) identifying pixels to which a compensating printing element of the defective printing element is assigned and which have a value zero;

e) changing the value of at least one identified pixel into an integer value greater than zero;

f) increasing the first printer resolution in the main-scanning direction to a second printer resolution in the main-scanning direction by multiplying the first printer resolution in the main-scanning direction with a factor equal to (n+x)/n.

14. A computer program embodied on a non-transitory computer readable medium and comprising computer program code to enable a printer to execute the method of claim 1.

* * * * *